United States Patent [19]

Arnold

[11] 4,068,730

[45] Jan. 17, 1978

[54] DRILL COLLAR

[76] Inventor: James F. Arnold, 241 Kilts Drive, Houston, Tex. 77024

[21] Appl. No.: 763,101

[22] Filed: Jan. 31, 1977

[51] Int. Cl.[2] ..... E21B 17/00

[52] U.S. Cl. ..... 166/320; 64/1 S

[58] Field of Search ..... 175/61, 320, 321; 64/1

[56] References Cited

U.S. PATENT DOCUMENTS

| | | | |
|---|---|---|---|
| 2,186,725 | 1/1940 | Hughes | 175/61 |
| 2,329,597 | 9/1943 | Diehl et al. | 175/73 |
| 2,841,366 | 1/1958 | Dunn | 175/320 |
| 3,160,218 | 12/1964 | Crake | 175/325 |
| 3,391,749 | 7/1968 | Arnold | 175/61 |

*Primary Examiner*—James A. Leppink

[57] ABSTRACT

An improved eccentrically weighted drill collar is provided which has a basically stronger structure and stress carrying ability than the eccentrically weighted collar heretofore in field use. The eccentric weighting is provided by a series of blind holes extending down one side of the drill collar. The stronger structure and stress carrying ability is afforded by arranging such holes so that they vary in size in a cyclical pattern along the length of the drill collar.

9 Claims, 3 Drawing Figures

DRILL COLLAR

This invention relates to an improved eccentrically weighted drill collar of the type shown and described in my U.S. Pat. No. 3,391,749 issued July 9, 1968 which is incorporated herein in its entirety by reference thereto.

The drill collar described in the above patent has gained market acceptance because of its effectiveness in reducing and preventing deviation during drilling of bore holes in the earth. It also avoids the problems of doglegging, key seating and the use of expensive packed hole assemblies, all of which are common when crooked hole tendencies exist in a well. Also, field experience has shown that such a collar can improve the drilling rate and reduce the number of bits used in drilling while maintaining a hole within desired limits of deviation. When used properly, it can result in substantial reduction in the time and cost of drilling wells in certain areas as compared to conventional drilling with slick collars.

In any crooked or deviated borehole, there exists a force generated by the pendulum effect of the lower end of the drill string. Thus the earth's gravitational force exerts a downward pull upon the drill string. The string reacts to this pull by trying to "swing" through the low side of the hole toward a true vertical orientation. When using ordinary slick collars, this pendulum effect is not strong enough to overcome the physical and structural forces in the earth's strata which cause a hole to deviate. In other words, the force or reaction tending to deviate the hole is greater than the counterforce or reaction tending to return it to vertical.

The eccentrically weighted drill collar of the above patent magnifies the pendulum effect to such an extent that the forces tending to cause the drill string to return to vertical are greater than those of the formation tending to cause it to deviate. Thus the eccentrically weighted drill collar is provided with a "light" side (as for example by drilling a series of holes along one side) and a "heavy" side diametrically opposed to the light side. Then as the drill string rotates the collar about its center during drilling, centrifugal forces are generaged. When the heavy side of the collar is on the high side of the hole, the force of the gravitational pendulum effect and the resultant contrifugal force tend to cancel each other out. The net effect upon the collar tends toward a balance between these two forces.

As the collar's heavy side continues in its revolution around the center line of the drill string, the gravitational pendulum effect and the resultant centrifugal force of the heavy side of the collar tend to coincide and are additive. The collar, as a result of this, tends to push the bit with increased force toward the low side of the hole. This action occurs once during each revolution of the drill string and the cumulative affect is to cause the hole being dug to "deviate" back toward vertical.

The eccentrically weighted drill collar described in the above patent includes a series of uniformly sized blind holes, slots or grooves arranged in series along one side of the drill collar. This effectively weakens one side of the drill collar along its entire length while the other side remains at its original slick collar strength. All drill collars including the eccentrically weighted ones, are, in service, constantly subjected to high levels of stress and strain as a result of the grinding, tearing vibrations of the bit and of the torque transmitted by the drill string to the bit.

It is an object of this invention to improve the strength and hence the stress carrying ability of eccentrically weighted drill collars of the type shown in the Arnold patent.

Another object is to improve the drill collar of the Arnold patent by removing weight therefrom in such a manner that the resulting eccentrically weighted drill collar is stiffer in its overall length which is tantamount to improving the drilling action of the drill string.

Other objects, advantages and features of the invention will be apparent to one skilled in the art upon study of the specification, the claims and the drawings, wherein:

Figure 1:
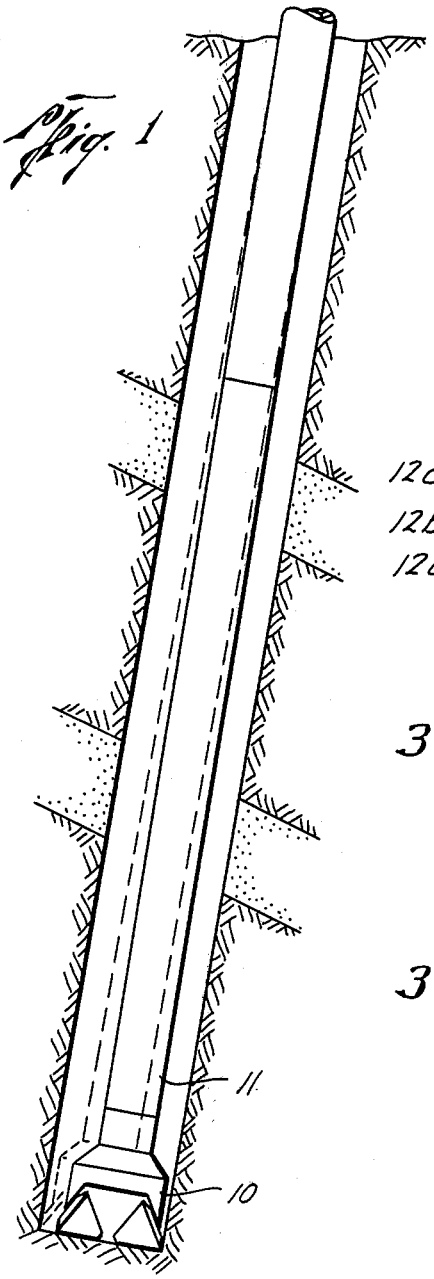
FIG. 1 is a vertical section showing a bit connected to an improved collar made in accordance with this invention, the deviation shown being exaggerated to make it more clearly apparent.

Referring now to FIG. 1, a conventional drilling bit 10 is shown mounted at the bottom of drill collar 11. This collar is substantially straight. By this it is meant that, when placed in a stationary position under normal compression, no portion of the collar will project radially beyond the periphery of the bit. The outer surface of the collar is preferably concentric with or symmetrical with respect to its longitudinal axis. Thus the collar has parallel and coincidental axes of symmetry and rotation. One side of the collar is however, heavier than the other so that as the drill string rotates, the collar will tend to revolve or gyrate about the longitudinal axis of the borehole. As it does so, the bit swings from its solid line position against the low side of the hole to its dotted line position toward the high side once every revolution. As hereinbefore pointed out, every time the heavy side of the collar approaches the low side of the hole, a force is generated to produce an abrasive pounding of the low side of the hole but as the heavy side of the bit rotates toward the high side of the hole, the forces generated by rotation of the drill string tend to cancel out so that the high side of the hole has much less force exerted against it by the bit than the low side.

Figure 2:
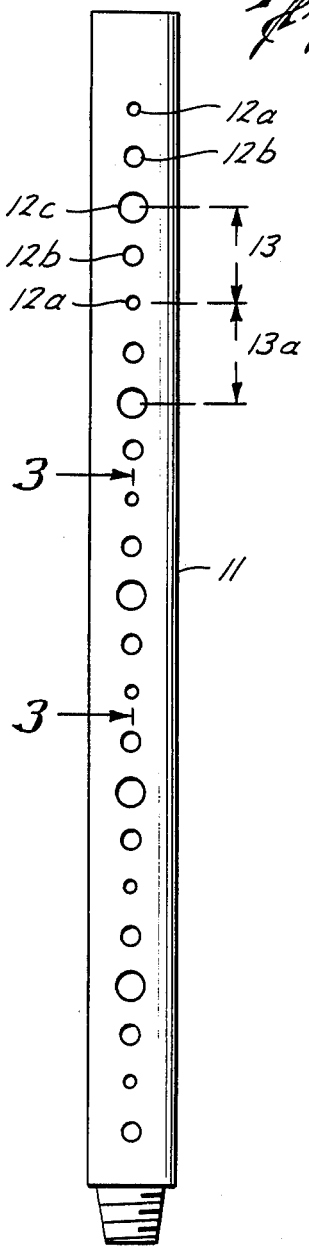
FIG. 2 is an elevational view showing a preferred embodiment wherein the weight relief is obtained by a cyclically occurring series of blind holes.
Figure 3:
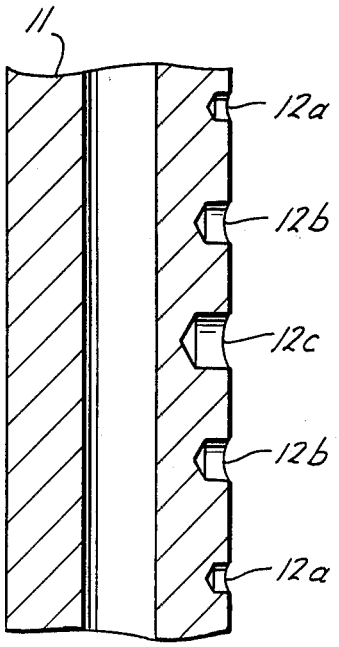
FIG. 3 is a view taken on a line 3—3 of FIG. 2.

As illustrated best in FIGS. 2 and 3, the eccentric weighting of the drill collar is provided by a line of blind holes **12*a*, 12*b* and 12*c*. As will be seen, this line extends along one side of the drill collar. Also the size (diameter and depth) varies from a maximum to a minimum along the length of a plurality of zones which zones collectively extend along substantially the length of the collar. Thus one zone is designated at 13 and it will be seen that the weight removed therein varies from a maximum at the upper end of the zone to a minimum at the lower end of the zone. Also it will be noted that the weight removed in the pair of contiguous zones 13-13*a*** varies from a maximum at the opposite ends of the zones to a minimum at their center, i.e., where they abut.

The total weight removed from the basic slick collar can be in the range of one-half to ten percent of the original weight of the collar and is preferably in the range of three to five percent.

Although the mode of weight reduction or relief has been specifically shown as consisting of drilled holes, the "holes" can take other forms such as the slots, grooves, etc. shown in the Arnold patent.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. An eccentrically weighted drill collar for connection in a drill string above a drill bit in an earthen borehole comprising a straight tubular member having means at the lower end thereof for connection to a rotary drill bit to provide a common axis of rotation of said member and said bit; said member being weight-relieved along one side thereof to produce an eccentric weighting on opposite sides of the member corresponding to one-half to ten percent of the original weight of said collar; the amount of said weight removed varying between a maximum and a minimum along the length of each of a plurality of zones which zones collectively extend along substantially the length of the collar.

2. The collar of claim 1, wherein the weight removed in a pair of contiguous zones varies from a maximum at opposite ends of said zones to a minimum at the center of said zones.

3. The collar of claim 2, wherein the weight removed is in the range of 3 to 5 percent.

4. The collar of claim 1, wherein a plurality of drilled blind holes of varying diameter and depth, in a conventional slick collar provide the weight removed.

5. The collar of claim 4, wherein the weight removed is in the range of 3 to 5 percent.

6. An eccentrically weighted drill collar for connection in a drill string above a drill bit in an earthen borehole comprising a straight member having parallel axes of symmetry and rotation which member is eccentrically weighted with respect to a plane passing through said axis of rotation, said member being radially contained within the circle described by rotation of said drill bit in drilling said borehole and having no portion which preferentially bears upon the wall of the borehole during use; said eccentric weighting being provided by a line of blind holes extending along one side of the member, the size of said holes varying from a maximum to a minimum along each of a plurality of vertically spaced zones extending along the length of said collar.

7. The drill collar of claim 6, wherein the weight removed is in the range of one-half to ten percent of the original weight of said collar.

8. The drill collar of claim 7, wherein the weight removed is in the range of 3 to 5 percent.

9. An eccentrically weighted drill collar for connection in a drill string above a drill bit in a borehole comprising a straight tubular member having means at its lower end for connection to a rotary drill bit to provide a common axis of rotation of said member and said bit; a plurality of blind holes in said member on one side only extending along a line parallel to said axis, the size of the holes varying cyclically through a plurality of cycles along the length of the member, the size varying from a maximum to a minimum to a maximum for each cycle.

* * * * *